United States Patent [19]

Skeen

[11] 4,228,671

[45] Oct. 21, 1980

[54] PROCESS FOR MAKING A VEHICLE WHEEL

[75] Inventor: James E. Skeen, Pacific Palisades, Calif.

[73] Assignee: Superior Industries International, Inc., Van Nuys, Calif.

[21] Appl. No.: 25,788

[22] Filed: Apr. 2, 1979

[51] Int. Cl.[3] ..... C21D 7/06

[52] U.S. Cl. ..... 72/53; 29/159.01; 29/159.1

[58] Field of Search ..... 72/53, 40; 51/319, 421, 51/423; 29/159 R, 159.01, 159.1

[56] References Cited

U.S. PATENT DOCUMENTS

| | | | |
|---|---|---|---|
| 1,116,776 | 11/1914 | Wilcox | 72/53 |
| 2,252,823 | 8/1941 | Wallace | 72/53 |
| 2,341,674 | 2/1944 | Wallace | 72/53 |
| 2,542,955 | 2/1951 | Young | 72/53 |
| 2,758,362 | 8/1956 | Benedict | 72/53 |
| 3,073,022 | 1/1963 | Bush | 72/53 |
| 3,383,803 | 5/1968 | Schulte | 72/53 |
| 3,648,498 | 3/1972 | Voss | 72/53 |
| 3,855,683 | 12/1974 | Philipp | 29/159.01 |
| 3,874,054 | 4/1975 | Reppert | 29/159.01 |
| 3,886,774 | 6/1975 | Stromstedt | 72/53 |

*Primary Examiner*—Francis S. Husar
*Assistant Examiner*—Gene P. Crosby
*Attorney, Agent, or Firm*—Fulwider, Patton, Riber, Lee & Utecht

[57] ABSTRACT

A process for making an aluminum vehicle wheel. The process includes casting the body of the wheel from aluminum. The drop center of the wheel is shot peened to seal air-transfer holes and also to increase the fatigue strength thereof. Next, both the drop center and the face of the wheel are shot peened with a finer shot to thereby reduce the surface roughness of the drop center and the face.

12 Claims, 10 Drawing Figures

PROCESS FOR MAKING A VEHICLE WHEEL

BACKGROUND OF THE INVENTION

In casting aluminum vehicle wheels, a comparatively large percentage thereof are sufficiently porous when cast as to leak air when a tire is mounted thereon. It is presently common to test for such air leaks by immersing the wheel casting in a water bath. The leaks detected by such water bath testing must then be sealed, generally by use of a liquid sealing compound. Where a large leak is detected, it has been proposed to peen the casting in the area of the leak. In many instances, however, it is not possible to seal a leak and the casting must be remelted. The cost of detecting and correcting air leaks adds appreciably to the cost manufacturing such vehicle wheels.

SUMMARY OF THE INVENTION

It is a major object of the present invention to provide a process for making a vehicle wheel which substantially eliminates the air leakage problems of prior wheel making processes.

A further object of the present invention is to provide a wheel making process of the aforedescribed nature which reduces the cost of making vehicle wheels.

Yet a further object of the present invention, is to provide a wheel making process of the aforedescribed nature which permits the fatigue strength of the vehicle wheel to be increased without any increase in the weight of the wheel.

A more particular object of the present invention is to provide a wheel making process of the aforedescribed nature wherein the wheel's drop center area is first shot peened to seal any air-transfer holes and additionally to increase the fatigue strength thereof, with both the drop center and the face of the wheel then being shot peened with a finer shot to thereby reduce the surface roughness of both the drop center and the face of the wheel. The reduction in surface roughness of the wheel's drop center facilitates mounting a tire thereon. The reduction in surface roughness of the wheel's face enhances the finished appearance thereof.

Other objects and advantages of the present invention will become apparent from the following detailed description when taken in conjunction with the accompanying drawings.

DESCRIPTION OF A PREFERRED EMBODIMENT

Figure 1:
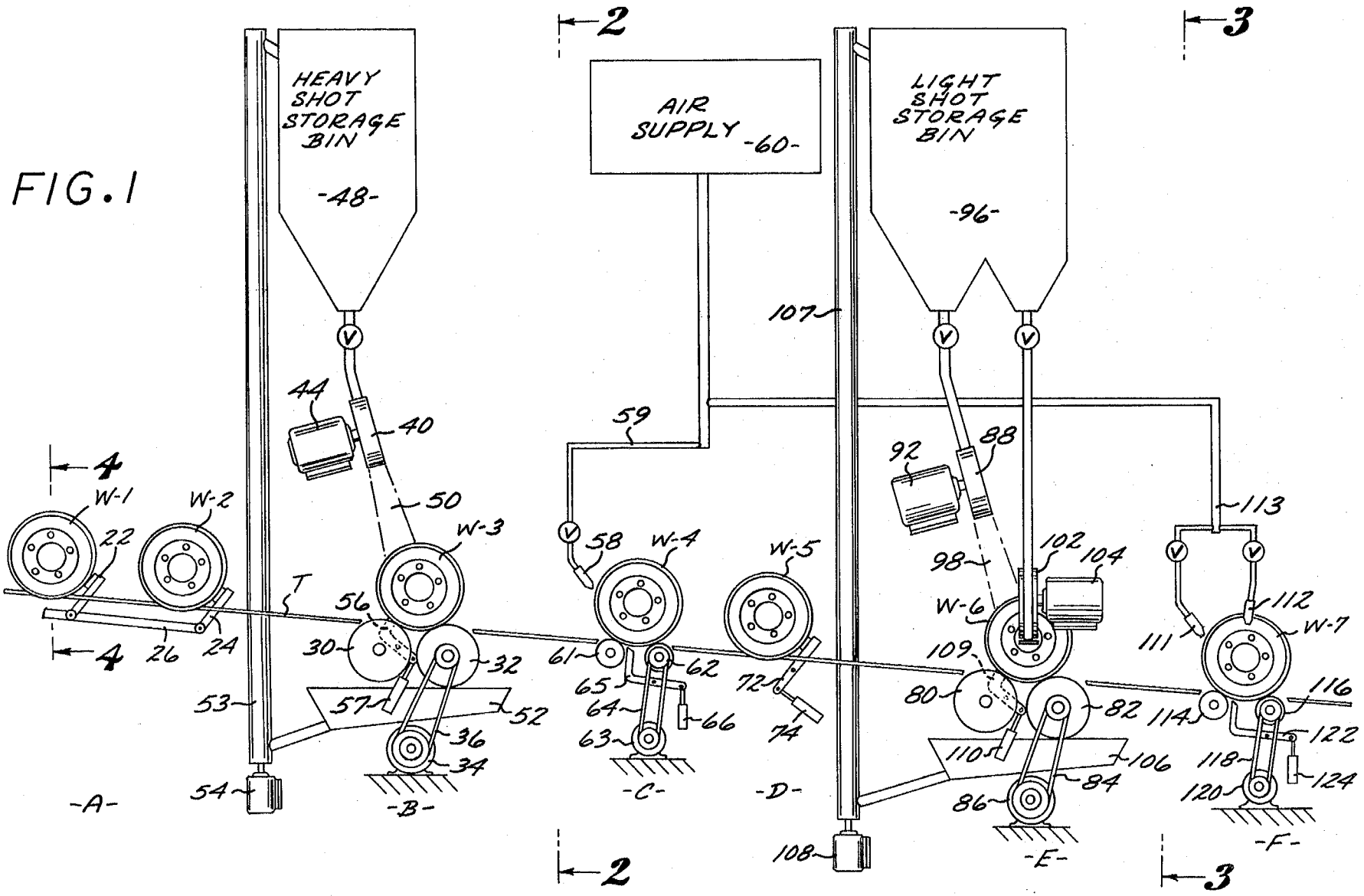
FIG. 1 is a schematic view showing various steps of a preferred form of wheel making process embodying the present invention.

Referring to the drawings, and particularly FIG. 1 thereof, there is shown a schematic view of the various steps of preferred process for making vehicle wheels in accordance with the present invention. It should be understood that the wheel castings W-1 through W-7 move from right-to-left with respect to FIG. 1 during such process. The extreme left-hand portion of FIG. 1 is designated A and represents an entrance feed step of the process. To the right of station A, is station B representing a first shot peening step of the process. At station C an air blast cleaning step takes place. Station D represents a second feed step of the process. Station E represents a second shot peening step of the process. Station F represents a final air blast cleaning step of the process.

Figure 4:
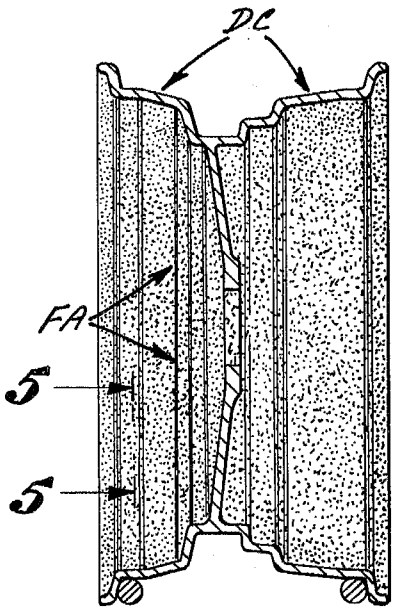
FIG. 4 is a vertical sectional view taken in enlarged scale along line 4—4 of FIG. 1, showing a central cross-section of a vehicle wheel casting made by said process.

A central cross-sectional view of an aluminum wheel casting W, which is processed in accordance with the present invention, is shown in FIG. 4. Referring thereto, such casting includes a circumferential drop center area DC constituting the area of the wheel that receives a tire. Such casting also includes a face area FA constituting the outer area of the wheel which is visable from the exterior of a vehicle upon which such wheel is mounted upon the vehicle.

More particularly, during the process of the present invention the wheel castings W-1 through W-7 roll along a downwardly inclined two rail track T, under the influence of gravity from station A to station F. It should be noted however, that such movement of the wheel castings may also be effected by manual or power actuated indexing means (not shown) along a horizontal track. At entrance feed station A, wheel castings W-1 and W-2 to be treated are initially retained at the upper portion of track T by a conventional feed escapement device, which includes first and second stop levers 22 and 24 pivotally connected at their lower ends to an actuating rod 26. Actuation of such rod 26 will cause levers 22 and 24 to be momentarily pivoted downwardly so as to permit casting W-2 to move along the track to station B, and casting W-1 to move along such track to occupy the position originally occupied by casting W-2. A new casting (not shown), is then moved into the position originally occupied by casting W-1. Suitable means (not shown) are provided for maintaining the wheel castings in a vertical position during their passage along track T.

Station B includes a pair of wheel-rotating rolls 30 and 32, with the latter roll being driven by an electric motor 34 through a belt 36. In practice, it has been determined that the wheel casting W-3 should be rotated at approximately 30 r.p.m., during the first shot peening step of the process. The shot peening of casting W-3 may be accomplished by the use of conventional shot peening apparatus. By way of example, the Rotoblast Peening Machine manufactured by Pangborn Division of the Carborundum Co., Hagerstown, Maryland, is suitable. Such shot peening equipment include a slinger wheel 40 driven by an electric motor 44, so as to direct shot from an elevated storage bin 48 onto the drop center area DA of casting W-3 in a blast stream designated 50. The drop center area DA is shown particularly in FIG. 4. A collection hopper 52 is disposed below rolls 30 and 32 to collect shot, which has been thrown onto casting W-3. The shot collected in hopper 52 moves into the lower end of a conventional shot elevator 53 driven by an electric motor 54, to be returned to storage bin 48 in a conventional manner.

The size of the steel shot applied to drop center A of the wheel casting should approximate S-460 for an exposure time of approximately fifteen to twenty seconds.

After the first shot peening operation, a kick-off lever 56 actuated by a power-operated cylinder and plunger unit 57 raises casting W-3 off rolls 30 and 32, and such wheel casting rolls down track T to air-blast cleaning station C. At station C wheel casting W-4 is exposed to a blast of compressed air through nozzle 58, so as to clean the drop center area of such casting of residual shot, aluminum dust or other foreign matter. Nozzle 58 is supplied by piping 59 from a source of pressurized air 60. The casting W-4 is rotated during the air cleaning operation upon a pair of rollers 61 and 62. The lowermost roller 62 is driven by an electric motor 63 through belt 64.

After the air-blast cleaning operation, a second kick-off lever 65 actuated by a power operated cylinder and plunger unit 66 raises wheel casting W-4 off rollers 61 and 62, and such casting rolls downwardly along track T to the second feed step station D. At this station casting W-5 is temporarily restrained against further movement by a conventional escapement mechanism, generally designated, which includes a lever 72 pivoted at its lower end to a cylinder and plunger unit 74. Actuation of the later will momentarily depress lever 72 so as to permit casting W-5 to move downwardly along the track T to the second shot peening station E.

Station E includes a pair of wheel-rotating rolls 80 and 82, with the latter roll being driven by an electric motor 84 through a belt 86. In practice it has been determined that the wheel casting W-6 should be rotated at approximately 30 r.p.m. At station E the drop center area DA, as well as the face area FA (See FIG. 4) of wheel casting W-6, will be shot peened with steel shot that is finer than the shot utilized at the first shot peening stage B. By way of example, shot approximating S-110 to 170 may be employed for an exposure time of approximately fifteen to twenty seconds. The shot peening apparatus utilized at station E may also be of the type manufactured by the aforementioned Pangborn Division of the Carborundum Company.

Figure 3:
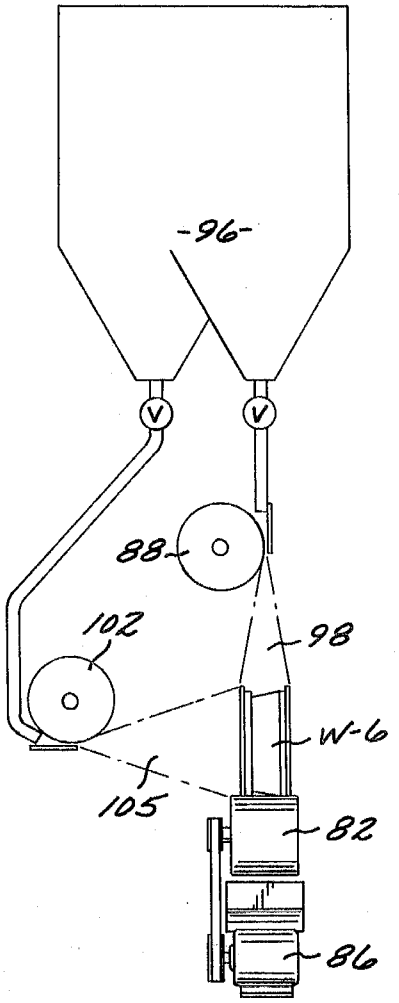
FIG. 3 is a vertical sectional view taken along line 3—3 of FIG. 1.
Figure 2:
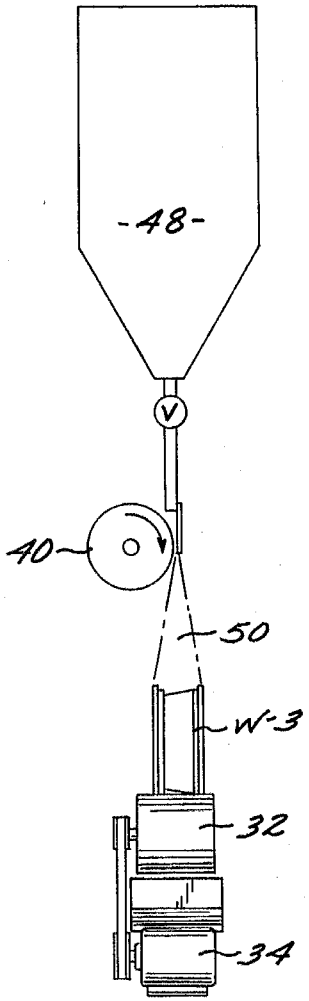
FIG. 2 is a vertical sectional view taken along line 2—2 of FIG. 1.

Such shot peening apparatus includes a slinger wheel 88, driven by an electric motor 92, so as to direct shot from an elevated storage bin 96 onto the drop center area DA of casting W-6 in a blast stream designated 98. The shot peening equipment also includes a second slinger wheel 102 driven by an electric motors 104, so as to concurrently direct shot onto the face area FA of wheel casting W-6 in a blast pattern 105 shown particularly in FIG. 3. Slinger wheels 88 and 102 receive shot from the overhead storage bin 96. Shot from the aforedescribed slinger wheels is collected in a collection hopper 106, disposed below rolls 80 and 82. The shot collected in such hopper moves into the lower end of a conventional shot elevator 107 driven by an electric motor 108, so as to be returned to storage bin 96 in a conventional manner.

After the second shot peening operation, a third kick-off lever 104 actuated by a power-operated cylinder and plunger unit 110 raises casting W-6 off rolls 80 and 82, and such casting rolls down track T to the final air-blast cleaning station F. At station F, wheel casting W-7 is exposed to a blast of compressed air through nozzles 110 and 111, respectively, so as to clean both the drop center area DA and the face area FA of any residual shot or aluminum dust. The nozzles are supplied by piping 112 from the aforementioned source of compressed air 60. The casting W-7 is rotated during the second air cleaning operation upon a pair of rolls 114 and 116. The lower-most roller 116 is driven by an electric motor 118 through belt 120. A fourth kick-off lever 122 actuated by a power-operated cylinder and plunger 124 lifts wheel casting W-7 off rolls 114 and 116 for movement off the right-hand end of track T.

It should be understood that partitioning means (not shown) may be provided between the aforedescribed stages to maintain the shot from storage bins 48 and 96 separate insofar as possible. Suitable screening means for the shot may also be utilized. Additionally, it should be noted that in the interest of clarity a single wheel casting is shown being processed at the various stages A through F. In practice, however, a pair of such wheel castings arranged in back-to-back, coaxially aligned relationship may be concurrently processed.

Figure 10:
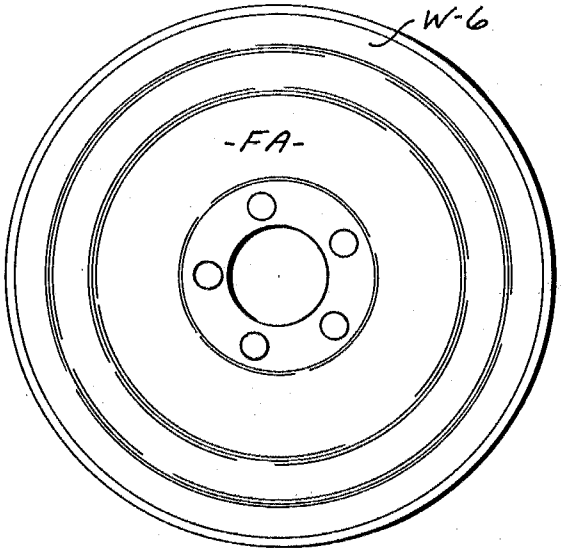
FIG. 10 is a view showing the face of the aforedescribed wheel casting after a final step in said process.
Figure 8:
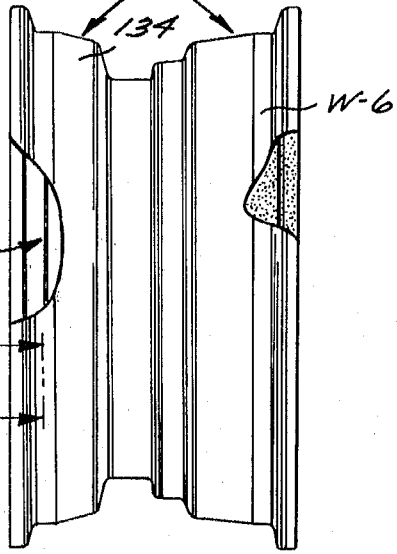
FIG. 8 is a cross-sectional view of the wheel casting of FIGS. 4 and 6 during a later step of said process.
Figure 6:
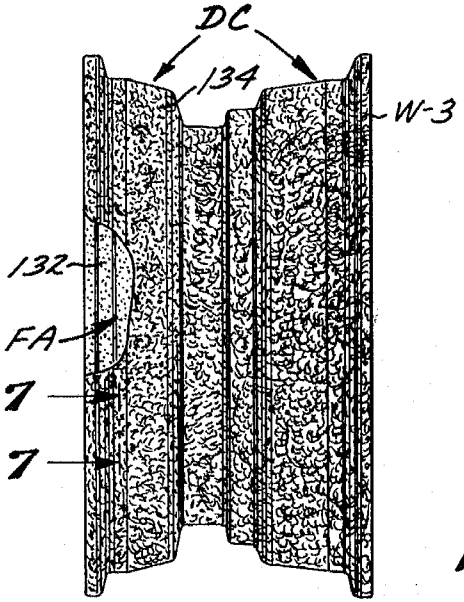
FIG. 6 is a side view of the wheel casting of FIG. 4, which is broken away to show a step of said process.
Figure 9:
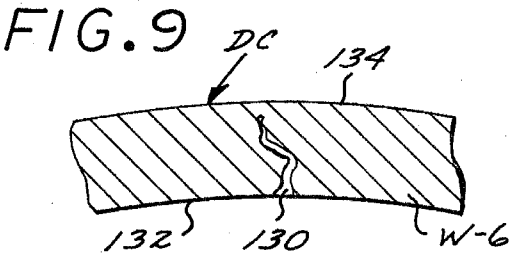
FIG. 9 is a sectional view in a further enlarged scale along line 9—9 of FIG. 8.
Figure 7:
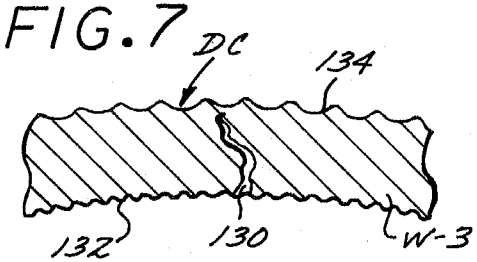
FIG. 7 is a sectional view taken in further enlarged scale along line 7—7 of FIG. 6.
Figure 5:
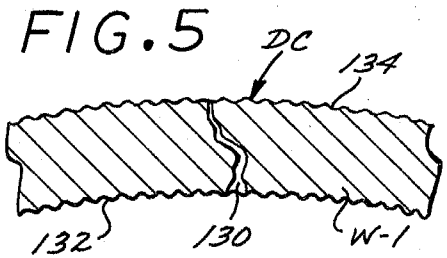
FIG. 5 is a sectional view taken in further enlarged scale along line 5—5 of FIG. 4.

The effects of the aforedescribed process on a wheel casting is illustrated in FIGS. 5 through 10. Referring first to FIG. 5, there is shown a segment of a wheel casting W-1 having an air leak passage 130, which must be sealed. Such passage 130 extends radially outwardly from the inwardly-facing surface 132 of the casting to the outwardly-facing surface 134 of the casting's drop center area DA. It is to be understood that initially exterior surface 134 is of a roughened texture resulting from the casting steps. When such wheel casting is subjected to the initial heavy shot peening at station B, the exterior surface 134 thereof will be additionally roughened, as indicated in FIGS. 6 and 7, and the outer portion of the air leak passage 124 will be sealed because of the working to which the metal is subjected by the shot peening. Such work hardening will also serve to increase the fatigue strength of the casting's drop center portion. Referring now to FIGS. 8, 9, and 10, at the conclusion of the second shot peening operation at station E, the exterior surface 134 of both the drop center area DA and the face area FA of the casting have been considerably smoothed as indicated at 128.

The surface 134 of the drop center area DA should be made sufficiently smooth that when a tire is being mounted thereon, the tire beads will readily slip over such area during inflation of the tire. Such bead slippage is essential to avoid damage. Smoothing of the castings face area FA removes any casting imperfections and provides a uniform surface texture. It should be noted that the increase in strength afforded by shot peening makes it possible to reduce the amount of metal used to cast a wheel made in accordance with the process of the present invention.

From the foregoing description it will be seen that the wheel making process of the present invention saves the costly leak detecting procedures hereinbefore required. Addtionally, the fatigue strength of the wheel is increased by virtue of the work-hardening effect of the shot peening. These advantages are gained in conjunction with an improved aesthetic appearance of the finished wheel. The process of the present invention may be conducted in less time than the wheel making processes of the prior art in view of the time necessitated by the heretofore proposed leak detecting and correcting methods.

Various modifications and changes may be made with the foregoing detailed description without departing from the spirit of the present invention.

I claim:

1. A process for making a vehicle wheel from a casting, having a drop center area and a face area, said process including the steps of:

shot peening the wheel's drop center area to seal any air-transfer holes therein and to also increase the fatigue strength thereof; and thereafter shot peening both said drop center area and the face area of said wheel with finer shot to thereby reduce the surface roughness of said drop center area and said face area.

2. A process as set forth in claim 1, wherein the size of the shot used to initially peen said drop center area approximates S-460 and the size of said finer shot approximates S-110 to 170.

3. A process as set forth in claim 1, wherein said casting is rotated during the shot peening steps.

4. A process as set forth in claim 1, wherein the size of the shot used to initially peen said drop center area approximates S-460 and the size of said finer shot approximates S-110 to 170; and said shot peening steps each take place for approximately 15 to 20 seconds.

5. A process as set forth in claim 1, wherein the size of the shot used to initially peen said drop center area approximates S-460 and the size of said finer shot approximates S-110 to 170; and wherein said casting is rotated during the shot peening steps.

6. A process as set forth in claim 1, wherein the size of the shot used to initially peen said drop center area approximates S-460 and the size of said finer shot approximates S-110 to 170;

wherein said casting is rotated during the shot peening steps; and said shot peening steps each take place for approximately 15 to 20 seconds.

7. A process for making a vehicle wheel from a casting having a drop center area and a face area, said process including the steps of:

shot peening the wheel's drop center area to seal any air-transfer holes therein and to also increase the fatigue strength thereof; and cleaning said drop center area; and thereafter shot peening both said drop center area and the face area of said wheel with finer shot to thereby reduce the surface roughness of said drop center area and said face area.

8. A process as set forth in claim 2, wherein the size of the shot used to initially peen said drop center area approximates S-460 and the size of said finer shot approximates S-110 to 170.

9. A process as set forth in claim 2, wherein said casting is rotated during the shot peening steps.

10. A process as set forth in claim 2, and said shot peening steps each take place for approximately 15 to 20 seconds.

11. A process as set forth in claim 10, wherein said casting is rotated during the shot peening steps.

12. A process as set forth in claim 9, wherein said shot peening steps each take place for approximately 15 to 20 seconds.

* * * * *